US012806504B2

(12) United States Patent
Tan

(10) Patent No.: US 12,806,504 B2
(45) Date of Patent: Nov. 24, 2026

(54) WEARABLE MULTI-SPORT SCOREKEEPING AND COUNTING DEVICE

(71) Applicant: Michelle Tan, Albany, CA (US)

(72) Inventor: Michelle Tan, Albany, CA (US)

( * ) Notice: Subject to any disclaimer, the term of this patent is extended or adjusted under 35 U.S.C. 154(b) by 462 days.

(21) Appl. No.: 18/387,046

(22) Filed: Nov. 5, 2023

(65) Prior Publication Data

US 2024/0149140 A1 May 9, 2024

Related U.S. Application Data

(60) Provisional application No. 63/422,932, filed on Nov. 5, 2022.

(51) Int. Cl.
*A63B 71/06* (2006.01)

(52) U.S. Cl.
CPC .. *A63B 71/0672* (2013.01); *A63B 2071/0663* (2013.01); *A63B 2071/0694* (2013.01); *A63B 2209/08* (2013.01)

(58) Field of Classification Search
CPC ..... A63B 71/0672; A63B 2071/0663; A63B 2071/0694; A63B 2209/08; A63B 2071/0602; A63B 2209/10
USPC ..... 116/222
See application file for complete search history.

(56) References Cited

U.S. PATENT DOCUMENTS 4,158,342 A * 6/1979 Scruggs ..... A63B 71/0672 273/DIG. 26
6,210,296 B1 * 4/2001 Gabriel ..... A63B 71/0672 116/225
8,904,951 B1 * 12/2014 Hronek ..... A63B 71/0669 116/225
2005/0187042 A1 * 8/2005 Rugh ..... A63B 71/0672 473/415
2010/0083698 A1 * 4/2010 Secord ..... A63B 71/0672 63/1.13
2012/0104058 A1 * 5/2012 Hernandez ..... A45F 5/021 224/660
2017/0007008 A1 * 1/2017 Pascale ..... A45F 5/00

FOREIGN PATENT DOCUMENTS

JP 3107568 U * 2/2005

OTHER PUBLICATIONS

JP 3107568 U translation (Year: 2004).*

* cited by examiner

*Primary Examiner* — Kristina M Deherrera
*Assistant Examiner* — Evan Mancini
(74) *Attorney, Agent, or Firm* — LANDMARK IP LAW, LLC; Gregory M Murphy

(57) ABSTRACT

The present invention is generally directed to a wearable, reliable, multi-sport scorekeeping device, including: a strap assembly; a housing, attached to the strap assembly; a ferromagnetic plate, disposed at least in part within the housing; and one or more magnets. In some embodiments, the invention may include an adjustable strap assembly; a band, having an opening therein through which at least a portion of the strap assembly is inserted; a housing having a top portion and a bottom portion, the bottom portion attached to the band; a ferromagnetic plate, disposed at least in part within the housing; a support substrate, disposed at least in part within the housing between the ferromagnetic plate and the band; printed sheet disposed between the ferromagnetic plate and the top portion of the housing, wherein the printed sheet has indicia thereon, indicating points, scores, or other information; and one or more magnets.

20 Claims, 9 Drawing Sheets

FIGURE 4
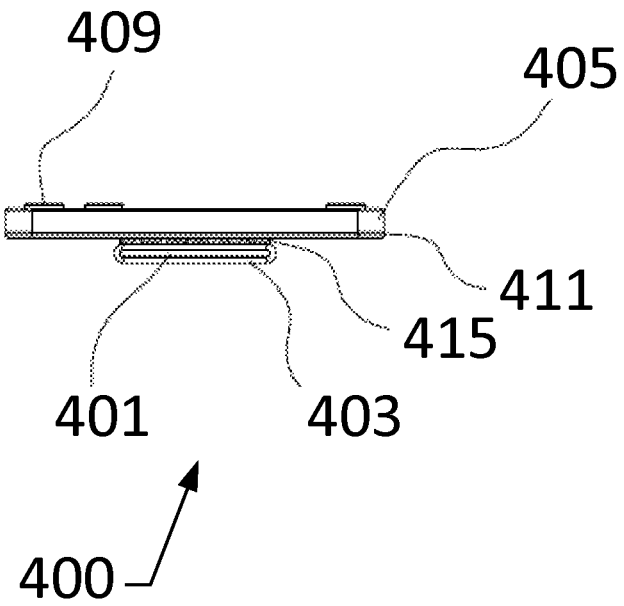
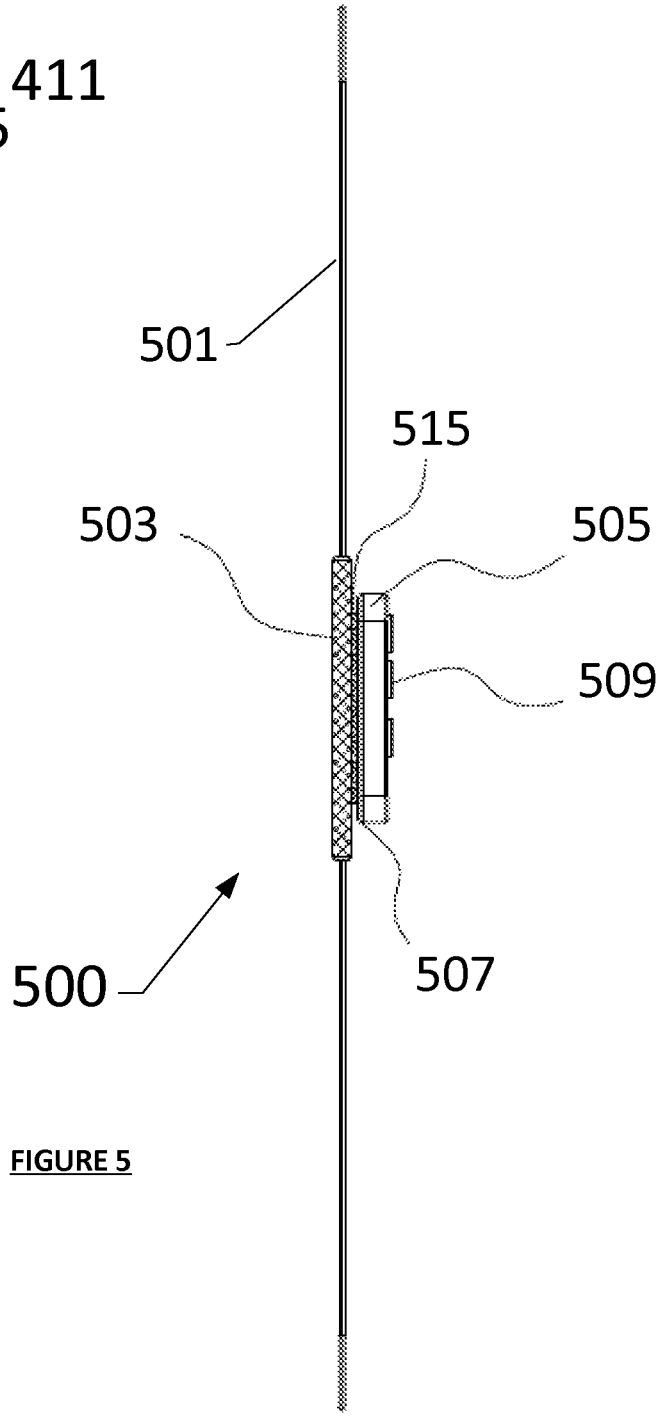
FIGURE 5

FIGURE 7
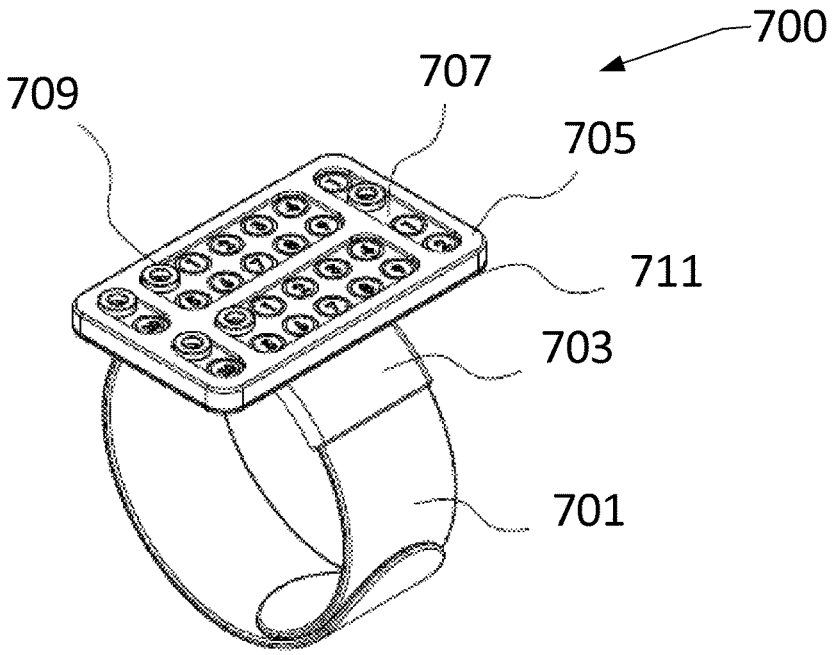
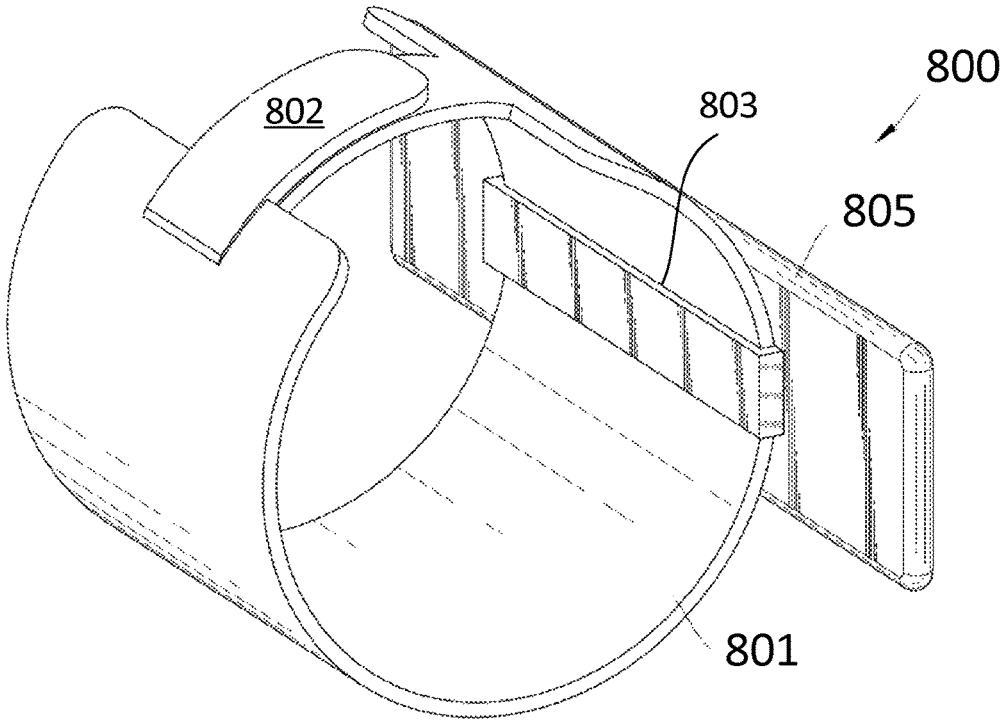
FIGURE 8

WEARABLE MULTI-SPORT SCOREKEEPING AND COUNTING DEVICE

PRIORITY APPLICATION

This application claims priority to U.S. Provisional Patent Application Ser. No. 63/422,932, entitled "Wearable Multi-Sport Scorekeeping and Counting Device," filed on 5 Nov. 2023, which is incorporated herein by reference in its entirety.

BACKGROUND OF THE INVENTION

Many sports and activities require an element of scorekeeping. However, sports often record points in different manners. For example, tennis is played in points: four (4) points win a game, six (6) games win a set, and two (2) or three (3) sets win a match. And the points in tennis are not numerically sequential. Rather, the sequence is 15, 30, 40, win. In contrast golf keeps track of the number of strokes a player uses to complete a hole, which is then compared to the par for the hole. Generally, golf stroke trackers need not exceed seven (7).

Some sports have similar scoring approaches but may differ in what is required by a player. For example, badminton, volleyball, ping pong, racquetball, etc. often track consecutive number of points earned by two (2) teams or individuals. However, the sport of pickleball requires the entire score to be called before the ball is served. In doubles matches, the entire score is made up of three numbers. The proper sequence for calling the score is: (i) serving team's score; (ii) receiving team's score; and (iii) the server number (either number one (1) or number two (2)). "What is the score?" and "Whose serve?" are two commonly asked questions by both new and veteran pickleball players whether young or old, especially after an exciting rally. Struggling to remember or fixating on the score to call out before serve may hinder a player from fully focusing on strategy and serve and may increase the odds of committing a fault. Indeed, according to the rules of pickleball if the server or referee calls the wrong score, once the serve is made, play shall continue to the end of the rally and the correction made before the next serve. After the serve is made, it is a fault to stop play after the return of serve to identify or ask for a score correction. It is also a fault to stop play to identify or ask for a score correction when the score was correctly called. There may be a fair amount of stress on a player to properly recite the score in the required manner. Accordingly, a device that assists in tracking the score and a player's server number is desirable.

Various devices may be used that may be visible to all players. In general, there are scorekeeping devices that hang over the net, and scorecards. Items that hang over a net have significant drawbacks in that (i) they are too heavy to drape over portable nets; (ii) players need to approach the net between each point, which can be inconvenient and unnecessarily waste time; (iii) generally only lists "Home" and "Guest" or "Visitor," which may not properly list the teams, nor provide a player's server number.

Score cards are (i) generally not configured to track a complete pickleball score; (ii) are often made with flimsy materials that may tear easily away from the binding or linking mechanism; (iii) often not laminated, so must remain dry; (iv) generally only show the score on one side, so one team may still be unaware of the score; and (v) may be too heavy to drape over portable nets.

Each of these devices is generally not as convenient as a wearable device. There are various scorekeeping devices and approaches known in the art, ranging from software applications to physical devices (waxed beads, rotating discs, etc.). Each, however, has significant drawbacks.

Software apps are generally only available on smartwatches, which are cost prohibitive for each player to purchase. In addition, displays on smartwatches are generally quite small, so not everyone can easily see or touch the surface of the screen accurately. There are certainly other drawbacks to smartwatches—ranging from technical understanding, exposure to electromagnetic fields, even anxiety and digital addition issues.

Beads and waxed string scoring devices similarly suffer from a number of drawbacks. For example, (i) in general if the score exceeds nine (9), there are only single numbers to keep double digit scores; (ii) there is no way to keep track of the server number for up to four players; (iii) beads may be difficult to move, and if waxed, the wax may wash or wear away through use (e.g., exposure to sweat, rain, elements, etc.) or through cleaning; (iv) freely rotates about the wrist, causing it to not always be disposed in a position to easily read the score; (v) petite players may have the beads wrap around their wrist to the point where it may still be difficult to see the score at one time. Moreover, to avoid the beaded bracelet from rotating or becoming loose during play, it must be relatively tight, which is often uncomfortable for players.

Much like beads and waxed strings, rotating discs also have a number of drawbacks: (i) it does not track a complete pickleball score; (ii) such devices often dangle (which can be both annoying and dangerous to a player moving about the court), or may be placed in a pocket (which reduces any convenience from having the score quickly visible); (iii) often requires two (2) hands or increased dexterity to operate; (iv) frequently pocketing the device often causes the discs to inadvertently rotate, thereby showing an incorrect score; and (v) pushing buttons to advance the score requires the user to avoid bumping the button during play, and requires multiple button presses to reset the device and return to zero (0).

Accordingly, a wearable, reliable, multi-sport scorekeeping device that allows for quick, convenient, and accurate tracking of a game's score, which is lightweight, low-tech, simple for all players to use, and adjustable for a secured, comfortable fit when worn on the arm is desirable. In addition, there is a need in the industry by players who are working on developing their sports skills and playing in singles or doubles games and trainers/coaches who are teaching others how to improve their sports skills to be able to track unforced errors made in a game. More specifically, there is a need in the industry for a wearable, reliable, pickleball scorekeeping device that allows for quick, convenient, and accurate setting of all three parts of a pickleball score, for singles, doubles, multi-player doubles, and 3-player games, which is lightweight, low-tech, simple for all players to use, and adjustable for a secured, comfortable fit, so players can focus on their serve and strategy and not the recollection of the score.

SUMMARY OF THE INVENTION

In accordance with some embodiments of the present invention, a wearable, reliable, multi-sport scorekeeping device may be taught, comprising: a strap assembly; a housing, attached to the strap assembly; a ferromagnetic plate, disposed at least in part within the housing; and one or more magnets.

In accordance with some embodiments of the present invention, a wearable, reliable, multi-sport scorekeeping device is disclosed, comprising: a strap assembly; a band, comprising an opening therein through which at least a portion of the strap assembly is inserted; a housing, the housing comprising a top portion and a bottom portion, the bottom portion attached to the band; a ferromagnetic plate, disposed at least in part within the housing; a support substrate, disposed at least in part within the housing between the ferromagnetic plate and the band; printed sheet disposed between the ferromagnetic plate and the top portion of the housing, wherein the printed sheet has indicia thereon, indicating points, scores, or other information; and one or more magnets.

In accordance with some embodiments, the magnets may comprise neodymium magnets, and may have an opening or orifice therein, through which printed indicia may be seen.

These and other aspects will become apparent from the following description of the invention taken in conjunction with the following drawings, although variations and modifications may be affected without departing from the scope of the novel concepts of the invention.

DESCRIPTION OF THE DRAWINGS

The present invention can be more fully understood by reading the following detailed description together with the accompanying drawings, in which like reference indicators are used to designate like elements. The accompanying figures depict certain illustrative embodiments and may aid in understanding the following detailed description. Before any embodiment of the invention is explained in detail, it is to be understood that the invention is not limited in its application to the details of construction and the arrangements of components set forth in the following description or illustrated in the drawings. The embodiments depicted are to be understood as exemplary and in no way limiting of the overall scope of the invention. Also, it is to be understood that the phraseology and terminology used herein is for the purpose of description and should not be regarded as limiting. The detailed description will make reference to the following figures, in which:

FIG. 4 illustrates a top view of a scorekeeping device, in accordance with some embodiments of the present invention.

FIG. 5 illustrates a side view of a scorekeeping device, in accordance with some embodiments of the present invention.

FIG. 7 illustrates a perspective view of a scorekeeping device, in accordance with some embodiments of the present invention.

FIG. 8 illustrates a perspective view of a scorekeeping device, in accordance with some embodiments of the present invention.

DETAILED DESCRIPTION

Figure 1:
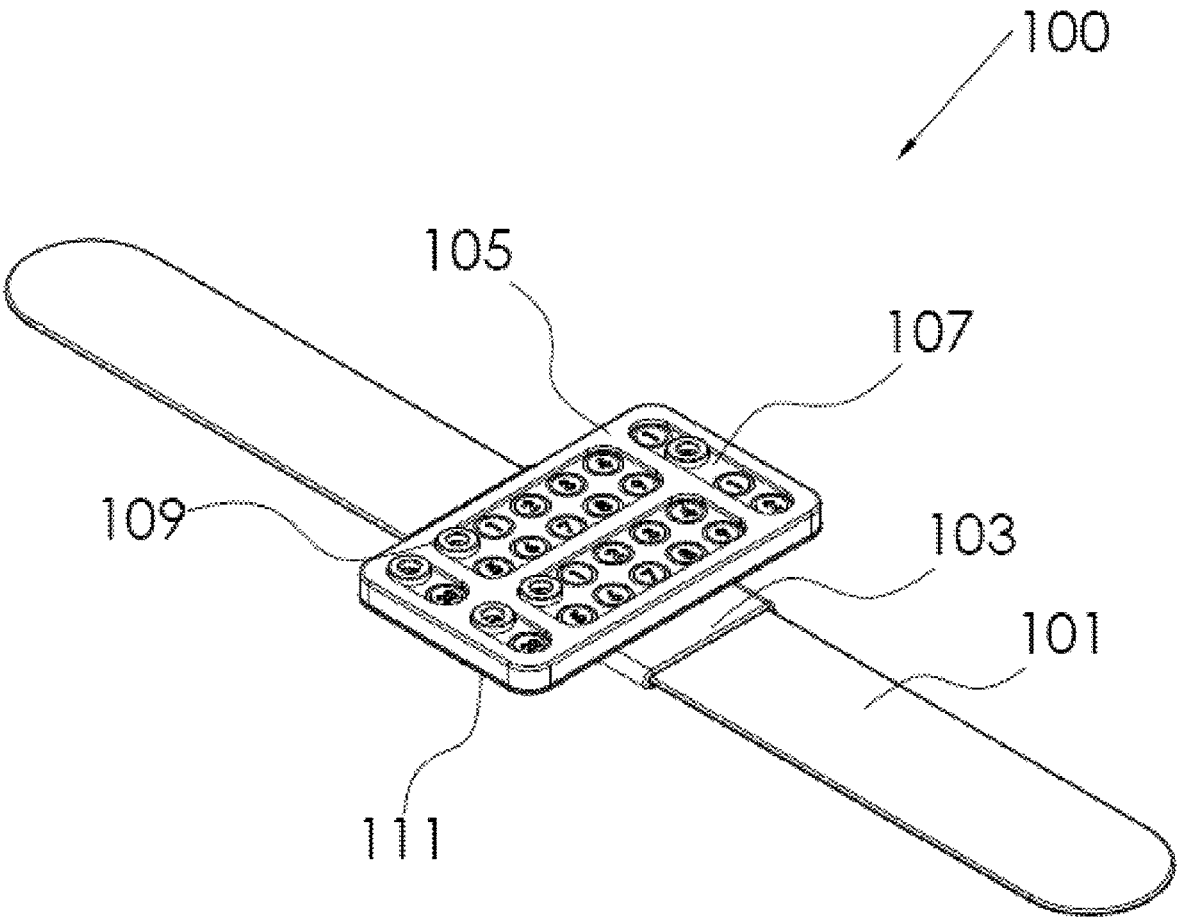
FIG. 1 illustrates a perspective view of a scorekeeping device, in accordance with some embodiments of the present invention.

Before any embodiment of the invention is explained in detail, it is to be understood that the present invention is not limited in its application to the details of construction and the arrangements of components set forth in the following description or illustrated in the drawings. The present invention is capable of other embodiments and of being practiced or being carried out in various ways. Also, it is to be understood that the phraseology and terminology used herein is for the purpose of description and should not be regarded as limiting.

The matters exemplified in this description are provided to assist in a comprehensive understanding of various exemplary embodiments disclosed with reference to the accompanying figures. Accordingly, those of ordinary skill in the art will recognize that various changes and modifications of the exemplary embodiments described herein can be made without departing from the spirit and scope of the claimed invention. Descriptions of well-known functions and constructions are omitted for clarity and conciseness. Moreover, as used herein, the singular may be interpreted in the plural, and alternately, any term in the plural may be interpreted to be in the singular.

The invention can be used for any occasion that requires a scorekeeping or counting device such as sports, events, children education, school, office, and repeatedly making or doing something (e.g., making wedding favors, knitting, crocheting, counting inventory, counting the number of times a word is said, counting the number of errors/faults made in a game, counting the number of games you win, counting the number of laps ran, and other tracked tasks). Furthermore, it is suited for tracking consecutive number of points, earned by teams or individuals, for games such as badminton, volleyball, ping pong, table tennis, racquetball, squash, fencing, bocce ball, wallyball, Basque Pelota, tennis, other similar non-contact sports, and it is especially suited for tracking a pickleball score.

Some advantages over scorekeeping devices as known in the art are that all the indicia are openly displayed on the scorekeeping plate and the use of ring magnets allows the indicia to be seen through the center hole of the magnet, and are easily moved by a user. Moreover, a device in accordance with some embodiments of the present invention may also set forth all numbers and scoring relevant to pickleball, including points earned during play (indicated by an "M" for "mine" and a "T" for "theirs," but also indicate server numbers. For singles, doubles, multi-player doubles, or 3-player pickleball games a device in accordance with the present invention may reliably track the three parts of a pickleball score.

In addition, if playing singles or doubles, multi-player doubles pickleball, unforced errors made by a single player or all players, or the number of matches won by a player can be tracked. As set forth in greater detail below, a user can quickly, conveniently, and accurately set a score as well as quickly change the score's number if it is determined a point or error/fault should not be counted.

Note that while the discussion herein predominantly addresses the sport of pickleball, it is contemplated that it is equally applicable to other sports, such as but not limited to fencing, volleyball, badminton, table tennis, bocce ball, tennis, and other non-contact player sports. It can be used by players, coaches, referees, and sport spectators. Apart from the fact that this invention serves as a scorekeeping tool, this device has a wide application and can be used in any circumstance that requires a counter.

The neodymium ring magnets maintain their position until the user changes their position, so the score is reliable, easy to see and easy to set. It's quick to change the count or reset to zero with an easy slide of the magnet. The adjustable strap assembly allows the user to comfortably secure the scorekeeping device to their limb, preferably a forearm, and the lightweight design of the scorekeeping device allows the user to move freely about. The device may also be easy to clean: once removed from a user's forearm the device may be wiped clean or sanitized.

In accordance with some embodiments of the present invention, a lightweight, wearable device that enables the tracking of consecutive integers, as well as a first action and a second action. In general, the device may comprise one or more magnets, a housing, one or more raised row separators, a substrate with printed indicia thereon, a ferromagnetic metal plate, and a strap assembly. Additional components may be included.

In accordance with some embodiments of the present invention, two or more raised rows may be disposed upon a substrate, and the substrate in turn may be attached or integrally formed with a strap. The substrate may comprise one or more layers, including for example, a transparent covering, a thin paper portion with printing thereon, and/or a dense plate for additional support. Straps or bands may be as known in the art, and may be adjustable, and may comprise any attachment mechanism as known (e.g., traditional watch clasp, bracelet buckle, hook-and-loop, snaps, buttons, etc.). In addition, the strap or band may be elastic and may stretch in order to be tightly but comfortably worn by a user. When the device is wrapped around the forearm and fastened, the scorekeeping devices sits securely atop the forearm of the user. The individual magnet pieces may sit atop the transparent protective covering due to the attraction between the magnets and the ferromagnetic metal plate and maintain their position until manually moved to another position.

In general, a device in accordance with some embodiments of the present invention may comprise a scorekeeping unit, score/number markers, and a strap assembly. The scorekeeping unit may be of any shape, though it is shown in the attached drawings as having a rectangular shape. The scorekeeping unit may comprise a first substrate, which may be attached to the strap assembly and may provide rigidity and strength to the scorekeeping unit. For example, the first substrate may be a dense cardboard plate.

Attached to the first substrate may be a second layer, which may comprise a ferromagnetic metal plate. This ferromagnetic plate may attract magnets, as discussed in greater detail below. Mounted on or attached to the ferromagnetic plate may be a thin substrate upon which printed material may be present.

In accordance with some embodiments, the printed material may be covered with a transparent covering, which may provide a smooth, easy-glide surface for the magnets to be slid across from one point to another. In addition, the transparent coating may protect printed material from sun damage, liquids, and wear and tear. Note that in accordance with some embodiments, the printed material may also be printed, etched, or engraved directly onto the ferromagnetic plate. The printed material may be any substrate that allows a magnetic force to pass through. For example, it may comprise paper, glass, resin, wood, composite material, plastics, etc. The printed material may either be imprinted on the top or bottom side and be imprinted with numbers, letters, lines, and circles to fulfill its purpose of keeping score or counting. Additional indicia may be used to expand/reduce the final count that can be achieved.

The printed material may comprise any material with printed information thereon. In accordance with some embodiments, printed material may comprise one or more lines that outline the edge of the rounded rectangular shaped plate and three (3) evenly spaced rows of indicia. Each row may comprise various indicia for tracking scores or repetitive motions. For example, and with reference to the figures, each row may set forth "30," "20," and "10," as well as "1" through "9" in order to effectively track points or motions up to 39. In accordance with some embodiments, the rows may include additional information. For example, one row may set forth indicators of the team ("M" for "mine"; "T" for "theirs"), and/or server numbers. The printed indicia may be sized in comparison to the ring magnets such that the indicia may be readable through the orifice in the ring magnet. Additional areas may remain blank or empty, as placeholders for a magnet not yet in use.

Number markers may comprise magnets that may be attracted to the ferromagnetic plate and may be used to track scores, amounts of repetitive motion, etc. Magnets may comprise neodymium (in order to provide a firm attachment), but other grades of magnetic material may be used. In accordance with some embodiments, the magnets are circular rings with open portions in the center, through which to view the printed material. However, it is also contemplated that magnets may be any shape or size, and may or may not include an opening or orifice therein. For example, magnets may be in the shape of, or attached to something, in the shape of an arrow, which may be used to point at the current score. In some embodiments, the number marker may comprise both a magnet portion and a decorative portion, which may comprise various shapes, colors, textures, etc.

In accordance with some embodiments of the invention, the marker may be made out of any material that would allow for a temporary, strong adhesion to the surface, such as vinyl stickers, hook-and-loop attachments, suction cups, etc. In some embodiments a wire or plastic frame may be fastened to the surface at the end points and allows a marker to be securely slid between the rows and hover over the circled number, so it doesn't have to actually stick to the surface to mark the score. Pegs inserted into holes or orifices may also be used.

In some embodiments the scorekeeping device may provide an area for a user to write or manually mark the score (via, for example, check or tick marks over each number). This embodiment may utilize chalk boards, white boards, grease pencils, a reflex display (e.g., cholesteric liquid crystal technology), etc. It is also contemplated that the scorekeeping device may comprise physically deformable portions, such as flexible dimples, which may be pressed and deformed in sequence to track a score. In short, the present invention contemplates various methods and devices for the recordation and tracking of points, scores, or repetitive motions.

In some embodiments, a top component may be disposed over the printed material, and may provide one or more slightly raised row separators which may act as guide rails for the magnets and separate different portions of the device for the magnets. Such row separators may run the entire length of the scorekeeping device, or may only run for part of the length, thereby allowing parked magnets room to be freely maneuvered into any row. In accordance with some embodiments, the rows may not be raised, but be printed material to indicate a demarcation between rows. Raised rows may be part of the housing (as shown in FIG. 1) or may be added to the device and attached via adhesive, magnets, or physical fasteners. For example, it is contemplated that the raised rows comprise protrusions which may be inserted into openings in the scorekeeping device, which may provide attachment via fasteners or through an interference fit.

In some embodiments, the scorekeeping device may have a rounded rectangle shape and may be comprised of a scorekeeping plate that is form-fitted inside the slightly larger rounded rectangle housing's low-profile cavity in such a way that the housing's cavity edges frame the scorekeeping plate, and the top surface of the scorekeeping plate is exposed except where the lip of the cavity frames the plate.

The housing may comprise the top component and a bottom substrate, or tray, onto which a band or strap may be coupled. The housing may be made out of any appropriate material, such as silicone, rubber, plastic, wood, carbon, metal, resin, and/or any matter that is able to support and secure the layers of the scorekeeping plate, metal plate and dense cardboard plate. In some embodiments, the opening in the housing is where the plates are seated and the edges of the opening that frame the plates may slightly overlap the plates' surface to prevent them from falling out. For softer, pliable material, the frame may be stretched/flexed a bit wider so the plates can drop in and then the frame returns to its normal form and is containing the plates. For firmer material, one edge of the housing may either be detached or a hinge, or an end cap which may be pulled out and inserted back in, such that the housing may be opened so the plates can be slid into the opening.

The bottom-side of the housing may comprise a mechanism to allow a strap to be coupled to the device. Coupling to the strap may be via any manner (fasteners, magnets, etc.). For example, magnets may be used to pull protrusions into indentations to align the strap with the device. Other mechanisms may be used (such as twist-and-lock, snaps, hook-and-loop, adhesives, buckles, clasps, using elastic devices to hold or tie it into place, etc.) and are contemplated by the present invention.

The strap assembly may comprise any strap or band as known the art, including but not limited to those with clasps, buckles, latches, elastic bands, hook-and-loop, etc. In accordance with some embodiments, the strap may resemble a traditional watch band, and may utilize clasps, buckles, hooks, hook-and-loop, snaps, cam locks, etc. to attach. In some embodiments, the strap may be a wider arm cuff or band, made of a comfortable material (such as but not limited to a neoprene material or blend).

In some embodiments, the strap assembly may comprise a head, body, and tail. The head may have openings to receive the tail, and may comprise a smooth, strong, flexible, and durable material that doesn't couple with the "hook" portion of the tail. This is so the hooks at the tip of the tail feed smoothly through the opening in the head. The body may sit between the head and tail of the adjustable strap assembly and may be made of a stretch fabric that can allow for the "hook" portion of the tail to connect. The stretch fabric may allow for adjustment of the material so the appropriate comfortable and secure fit can be achieved.

One flat side of the tail is a smooth surface. The side opposite to that contains two (2) surfaces and when the tail is passed through the small in the head of the band and bent so that the 2 different surfaces are pressed together, they temporarily bind strongly together until pulled apart. It is desirable that the tail be long enough so the ratio of the two different surfaces, allows all of one of the surfaces to completely touch the other different surface so the temporary bind is strong. This can be any stretch or non-stretch fabric (such as cloth, leather or metal that is scored so it coils) that incorporates a means to connect its end points that allow for narrow to wider diameter formation adjustments. The strap ends can connect via hook-and-loop, buttons, zipper, magnets, two interlocking pieces, snaps, or buckle. Or it could be a one-piece elastic band that slides onto the part of the arm and the elastic band has a coupling mechanism integrated in it so it couples and uncouples with the scorekeeping device. The strap assembly may also comprise a "slap bracelet" style attachment, where the straps are biased around a user's arm or wrist and the bias maintains the location of the device on the user's arm. The coupling mechanism could be parts that twist and lock, slide and lock, latch that fastens, magnets, snap, or connect via hook-and-loop. However, other types of coupling mechanisms or material compositions known in the art may be used.

In use, three magnets may be placed on blank or empty areas until a point (or an increment of one (1)) occurs. Three (3) magnets may be placed atop the three (3) blank or empty circles. One (1) magnet may be placed over the "2" integer if playing pickleball or can be placed over the indicia that represents the current server for the team that is serving. When applicable, one of the markers in the appropriate row on the far left is moved to the "1" integer and is progressively moved to the right as the score/count increments upwards from integers "1"-"9". Once the score/count reaches "10", the marker is then moved leftwards and placed atop the "10" integer. When the score/count reaches "11" a marker parked in the bottom right is then manually slid into the row where the "10" integer is covered and placed atop the "1" integer. As the score/count increments, the marker over the "1" is moved one more to the right. When a marker is over the "10" and in the same row a marker is over the "9" and the score increments one more time (20), the marker over the "10" is moved leftwards and placed over the "20" integer and the marker over the "9" in that row is moved back to one of the blank circles located in the bottom right corner and parked there till the score/count increments again. Each row uses up to 2 markers to track the score/count.

One (1) marker may be used to identify the server number of the player is serving. If playing 3-player cutthroat pickleball then the bottom row may be used for the third player. For 3-player games, a marker can be placed over the "2" in the row representing the server. When a fault happens and the next player is the server, a marker may be slid over the "2" in the row representing the server.

With reference to FIG. 1, an exemplary scorekeeping device 100 will now be discussed. Scorekeeping device 100 may generally comprise a strap assembly 101, a fixed band 103 for strap attachment, a housing 105, a magnetic plate 107, and one or more magnets 109. The fixed band 103 may permit the strap assembly 101 to slide through the fixed band 103, such that the device may be adjusted by a user to a desired location on the band. The housing 105 may at least partially enclose the magnetic plate 107, and may provide openings for the magnets 109 to attach to the magnetic plate 107 and slide thereon. The magnetic plate 107 may comprise printed material, or as discussed in greater detail below, an additional layer of printed material may be present over the magnetic plate to provide readable indicia to a user.

Figure 2:
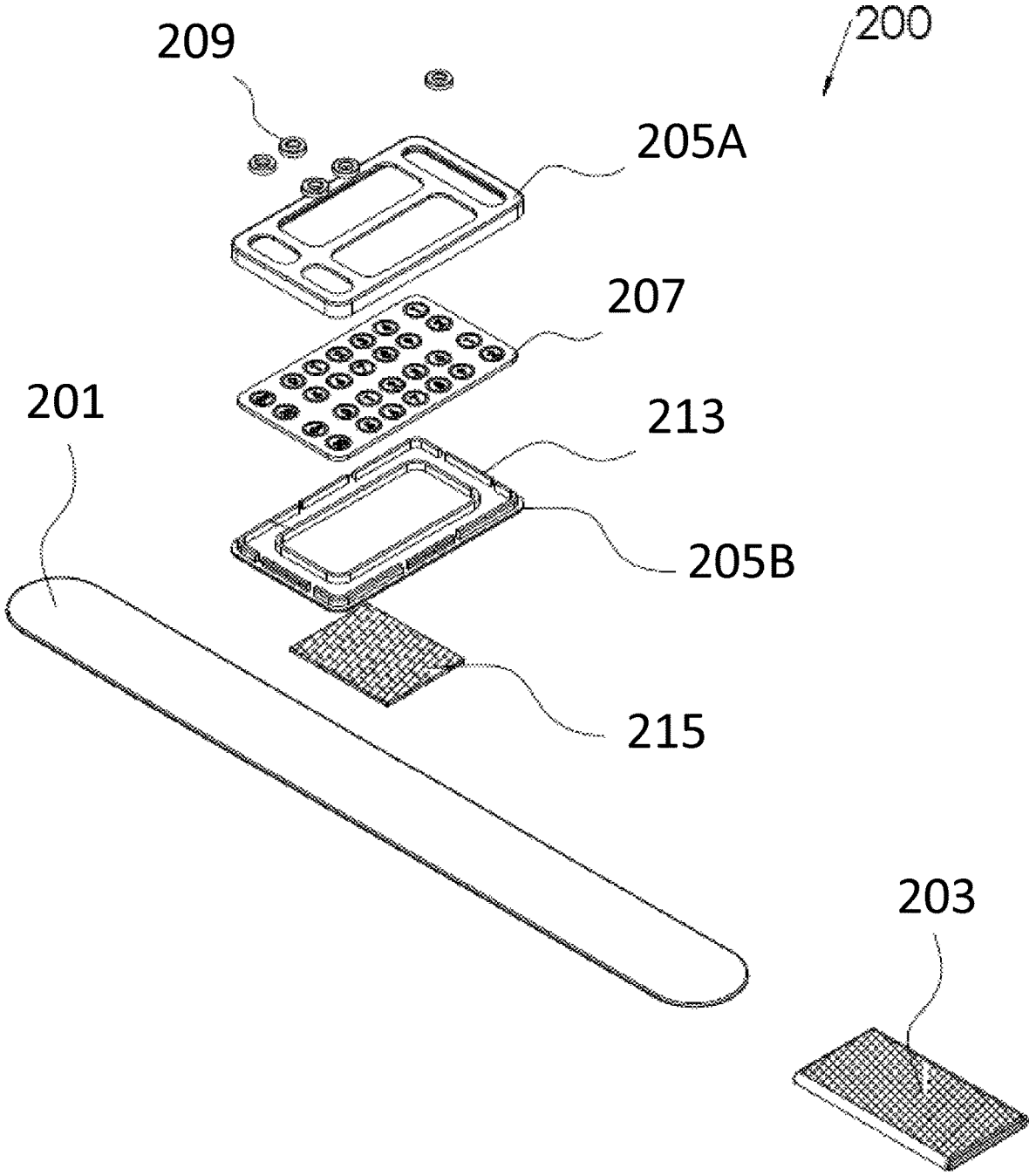
FIG. 2 illustrates an exploded view of a scorekeeping device, in accordance with some embodiments of the present invention.

With reference to FIG. 2, an exploded view of a scorekeeping device 200 will now be discussed. Scorekeeping device 200 generally comprises a strap assembly 201, a fixed band 203 which may attach to a attachment portion 215, a housing comprising a top portion 205A and a bottom portion 205B, a magnetic plate 207, and one or more magnets 209. The top and bottom housing portions 205A, 205B may mate together via any number of methods. For example, as shown the bottom housing portion 205B may comprise snaps or tabs that may be inserted into and mate or interface with elements on top housing portion 205A.

Figure 3:
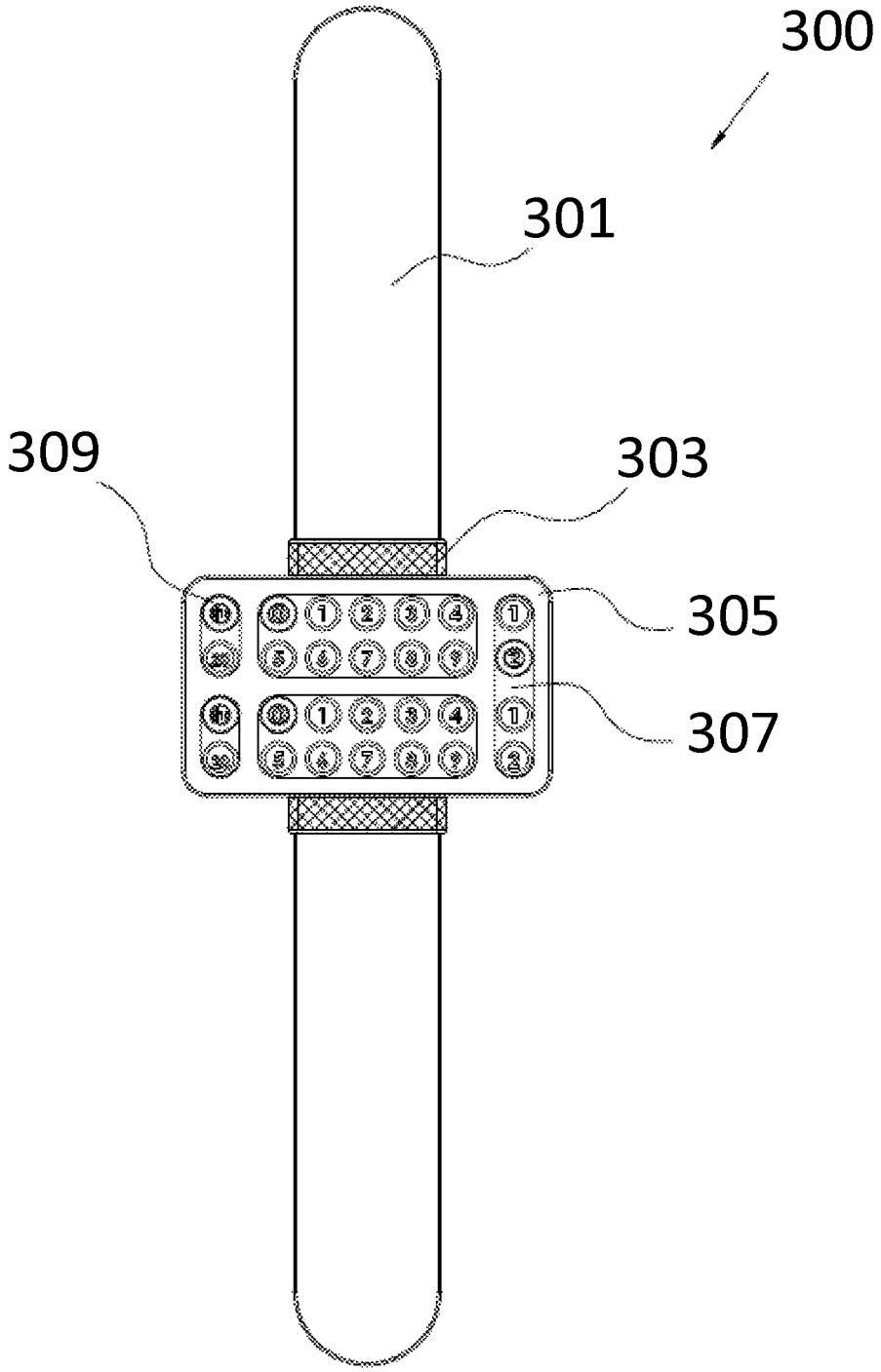
FIG. 3 illustrates a front view of a scorekeeping device, in accordance with some embodiments of the present invention.

In FIG. 3, a top view of a scorekeeping device 300 is shown. The device 300 may comprise a strap assembly 301, a fixed band 303, a housing 305, a magnetic plate 307, and one or more magnets 309.

FIG. 4 illustrates a side view of a scorekeeping device 400, which shows a strap assembly 401 that is inserted through an opening on fixed band 403, which in turn is connected to housing 405 via an attachment 415. One or more magnets 409 may be seen protruding from the housing in order to be easily moveable by a user. FIG. 5 shows an alternative side view of a scorekeeping device 500, again showing a strap assembly 501, fixed band 503, attachment portion 515, housing 505, magnetic plate 507, and one or more magnets 509.

Figure 6:
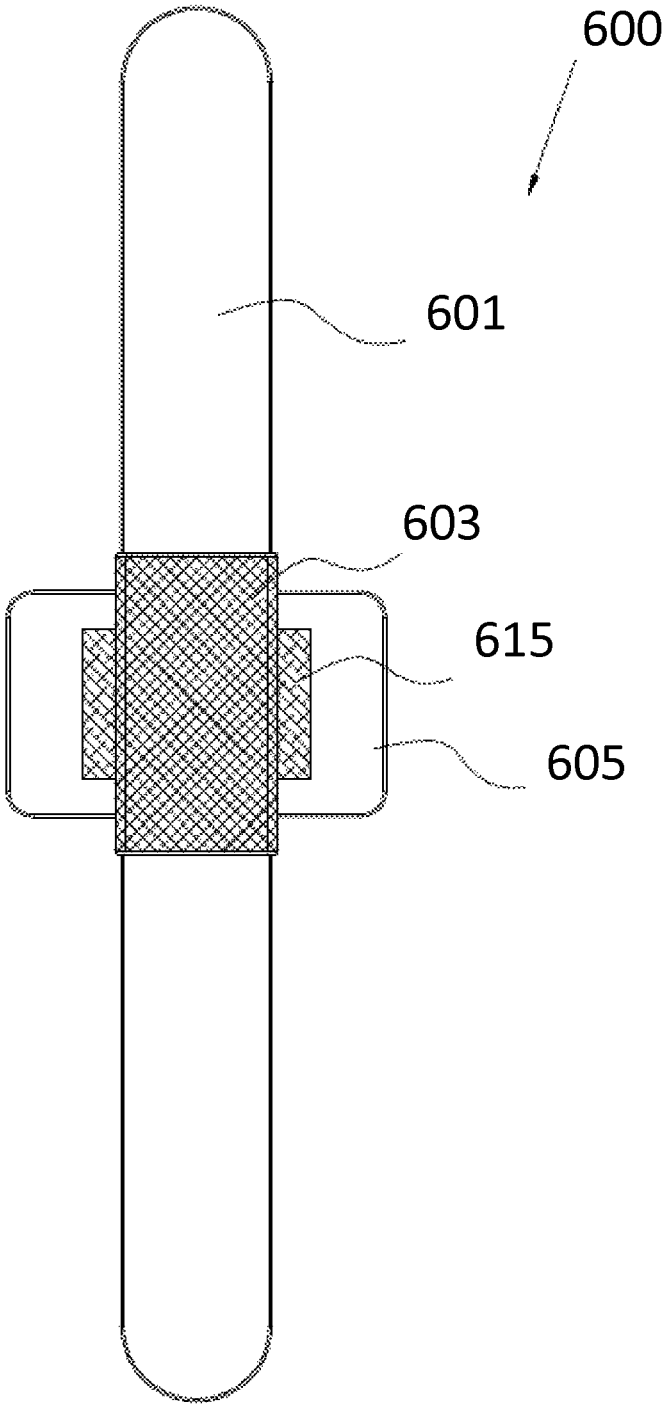
FIG. 6 illustrates a back view of a scorekeeping device, in accordance with some embodiments of the present invention.

FIG. 6 illustrates a bottom view of a scorekeeping device 600, comprising a strap assembly 601, fixed band 603, attachment portion 615, and a bottom surface of a housing 605.

FIG. 7 depicts a scorekeeping device 700 configured for wear, comprising a strap assembly 701, a fixed band 703 through which the strap assembly 701 is inserted, a housing 705, a magnetic plate 707, one or more magnets 709, and a substrate 711 (such as a dense cardboard plate) or a bottom half of the housing (each performs a similar function of supporting the device and attaching the elements to the strap assembly).

FIG. 8 illustrates a scorekeeping device 800 with a larger strap assembly, more like a cuff at 801, a fixed band 803, and a housing 805. Note that the strap assembly 801 may comprise an adjustment portion 802, which may be utilized by a user to loosen and/or tighten the strap assembly 801.

Figure 9:
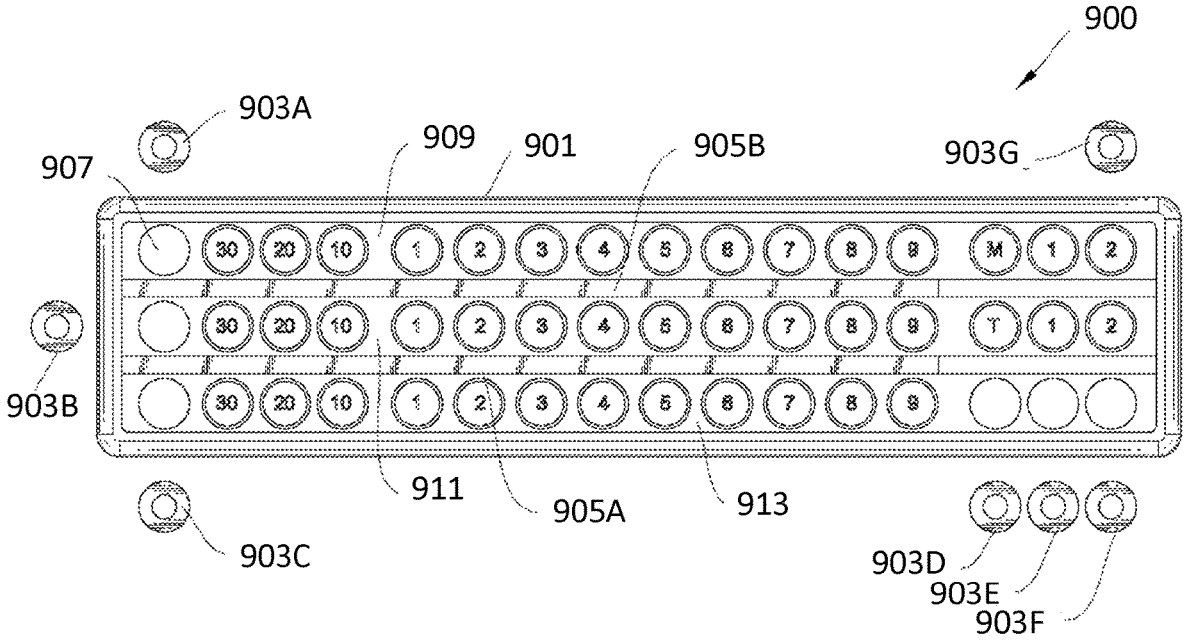
FIG. 9 illustrates a scorekeeping device, in accordance with some embodiments of the present invention.

FIG. 9 shows an exemplary view of the printed material on a scorekeeping device 900, in accordance with some embodiments of the present invention. Housing 901 may wrap at least partially around the printed material. Magnets 903A-903G may be used to keep score, track points, or count the number of various motions. In this particular embodiment, three (3) rows 909, 911, 913 of points or scores may be separated by raised row separators 905A, 905B. Circle indicia 907 may be blank or printed, and may be used to indicate where magnets 903A-903G should be attached.

Figure 10:
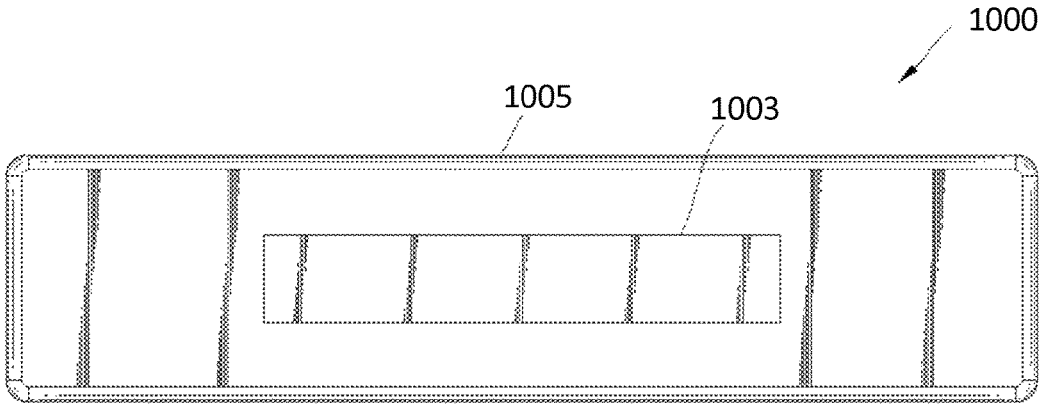
FIG. 10 illustrates a back view of a scorekeeping device, in accordance with some embodiments of the present invention.

FIG. 10 illustrates a bottom view of a scorekeeping device 1000, with the strap assembly not shown. A fixed band 1003 may be seen attached to a bottom surface of a scorekeeping device 1000, which may be at least partially enclosed by a housing 1005.

Figure 11:
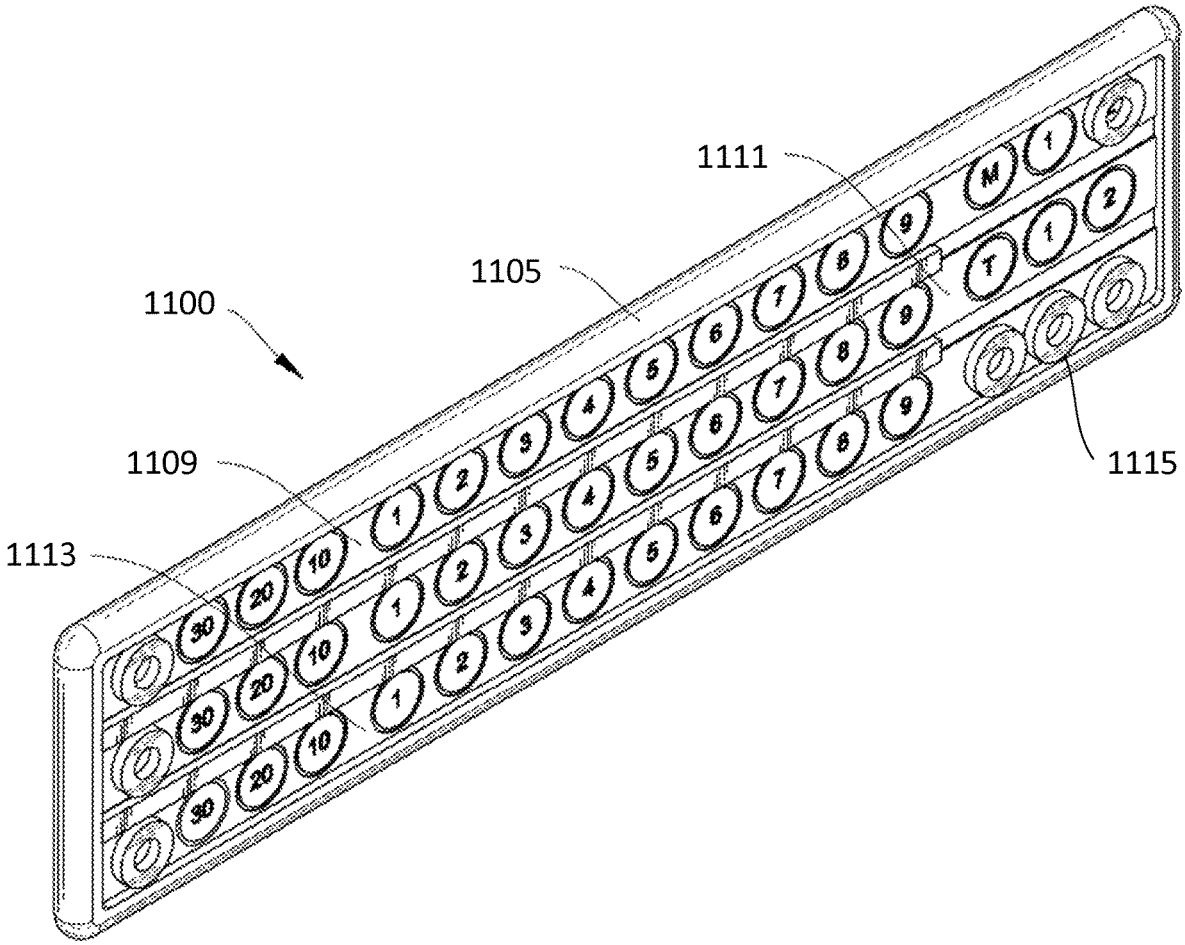
FIG. 11 illustrates a perspective view of a scorekeeping device, in accordance with some embodiments of the present invention.

FIG. 11 illustrates a scorekeeping device 1100, with the strap assembly not shown. Scorekeeping device 1100 may comprise a housing 1105 and three (3) rows 1109, 1111, 1113, which may be separated from each other by printed material, raised row separators, etc. Magnets 1115 may be attached to the scorekeeping device 1100, through the use of a magnetic plate behind the printed material, as discussed above.

Figure 12:
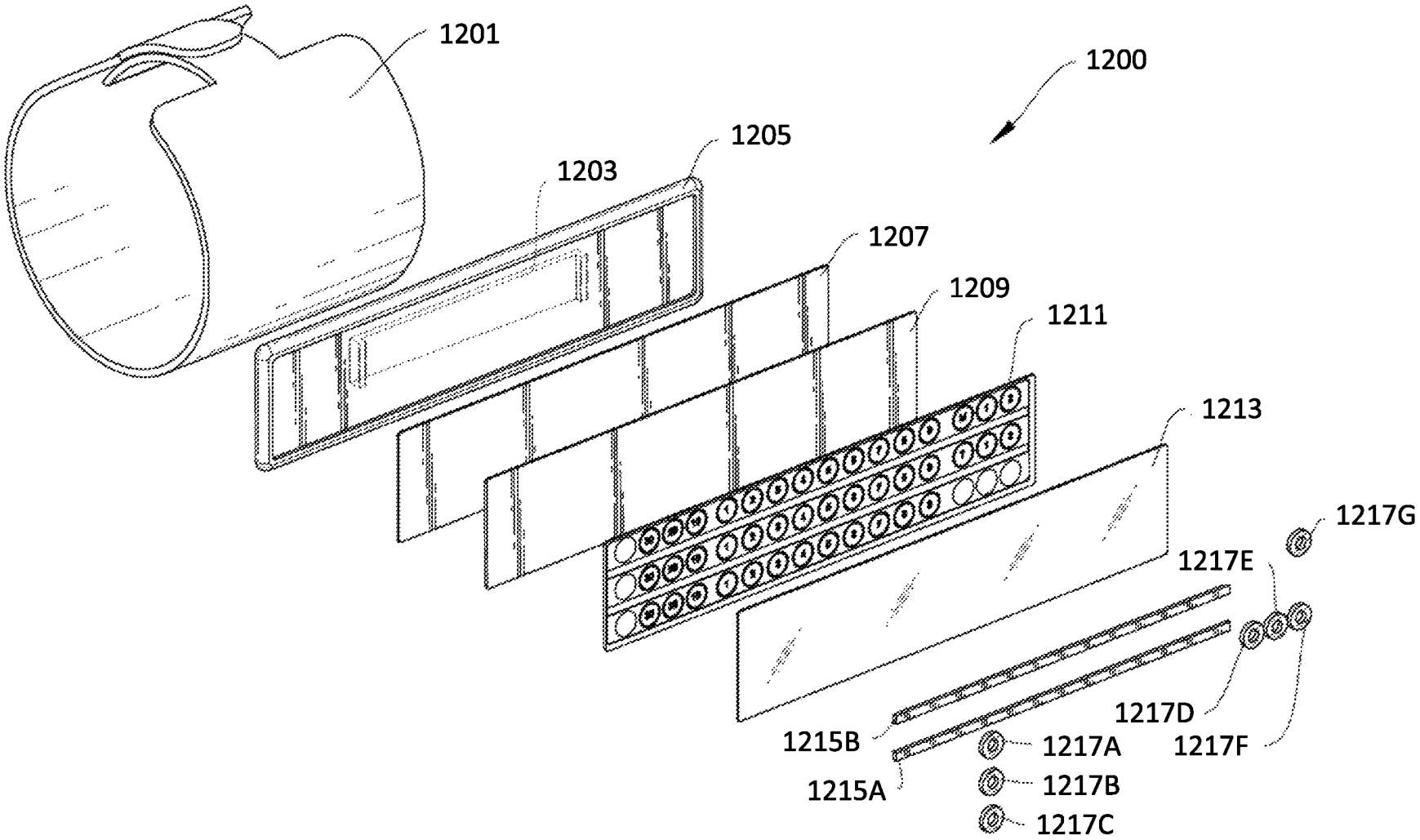
FIG. 12 illustrates an exploded view of a scorekeeping device, in accordance with some embodiments of the present invention.

FIG. 12 depicts an exploded view of a scorekeeping device 1200 in accordance with some embodiments of the present invention. In general, the scorekeeping device 1200 may comprise an adjustable strap assembly 1201, a fixed band 1203, a housing 1205, a support substrate 1207 (such as a dense cardboard plate), a ferromagnetic plate 1209, a printed sheet or plate 1211 with printed material thereon, a transparent protective covering 1213, one or more row separators 1215A, 1215B, and one or more magnets 1217A-1217G.

It will be understood that the specific embodiments of the present invention shown and described herein are exemplary only. Numerous variations, changes, substitutions and equivalents will now occur to those skilled in the art without departing from the spirit and scope of the invention. Accordingly, it is intended that all subject matter described herein and shown in the accompanying drawings be regarded as illustrative only, and not in a limiting sense, and that the scope of the invention will be solely determined by the appended claims.

What is claimed is:

1. A wearable, multi-sport scorekeeping device, comprising:

a strap assembly;

a housing, attached to the strap assembly;

a ferromagnetic plate, disposed at least in part within the housing; and one or more magnets configured to be removably retained against the ferromagnetic plate.

2. The device of claim 1, wherein the ferromagnetic plate has indicia thereon, indicating points, scores, or other information.

3. The device of claim 1, further comprising a printed sheet disposed between the ferromagnetic plate and the housing, wherein the printed sheet has indicia thereon, indicating points, scores, or other information.

4. The device of claim 1, wherein the housing comprises a bottom portion and a top portion, wherein the bottom portion is attached to the strap assembly and wherein the top portion comprises opening therein such the one or more magnets may be attached to the ferromagnetic plate.

5. The device of claim 4, wherein the bottom portion and top portion of the housing are attached together via a mechanical attachment, adhesive, heat welding, or fasteners.

6. The device of claim 4, wherein the bottom portion and the top portion of the housing are integrally formed.

7. The device of claim 1, further comprising a support substrate, configured to support the ferromagnetic plate and attach to the housing or the strap assembly.

8. The device of claim 1, further comprising a band, attached to the housing or a support substrate, the band having an opening therein through which the strap assembly is inserted at least in part.

9. The device of claim 1, further comprising row separators, the row separators raised and dividing the ferromagnetic plate into separate portions or rows.

10. The device of claim 9, wherein the row separators are integrally formed into the housing.

11. The device of claim 9, wherein the row separators are attached to the printed material or ferromagnetic plate.

12. A wearable, multi-sport scorekeeping device, comprising:

a strap assembly;

a band, comprising an opening therein through which at least a portion of the strap assembly is inserted;

a housing, the housing comprising a top portion and a bottom portion, the bottom portion attached to the band;

a ferromagnetic plate, disposed at least in part within the housing;

a support substrate, disposed at least in part within the housing between the ferromagnetic plate and the band;

a printed sheet disposed between the ferromagnetic plate and the top portion of the housing, wherein the printed sheet has indicia thereon, indicating points, scores, or other information; and one or more magnets.

13. The device of claim 12, wherein the bottom portion and top portion of the housing are attached together via a mechanical attachment, adhesive, heat welding, or fasteners.

14. The device of claim 12, further comprising row separators, the row separators dividing the printed sheet into separate portions or rows.

15. The device of claim 14, wherein the row separators are integrally formed into the housing.

16. The device of claim 14, wherein the row separators are attached to the printed material or ferromagnetic plate.

17. The device of claim 12, wherein the strap assembly is adjustable to loosen or tighten the strap on a user.

18. The device of claim 12, wherein the one or more magnets are neodymium magnets.

19. The device of claim 12, wherein the one or more magnets have an opening or orifice therein, through which printed indicia may be seen.

20. The device of claim 12, wherein the one or more magnets are attached to indicators, shaped as arrows or other shapes.

* * * * *